US010982458B2

(12) United States Patent
Valli

(10) Patent No.: US 10,982,458 B2
(45) Date of Patent: Apr. 20, 2021

(54) CARRIAGE FOR HANDLING VEHICLES

(71) Applicant: SOTEFIN PATENTS SA, Lugano (CH)

(72) Inventor: Giovanni Valli, Cantello (IT)

(73) Assignee: SOTEFIN PATENTS SA, Lugano (CH)

( * ) Notice: Subject to any disclaimer, the term of this patent is extended or adjusted under 35 U.S.C. 154(b) by 163 days.

(21) Appl. No.: 15/876,348

(22) Filed: Jan. 22, 2018

(65) Prior Publication Data

US 2018/0230706 A1 Aug. 16, 2018

(30) Foreign Application Priority Data

Feb. 13, 2017 (IT) ..... 102017000015512

(51) Int. Cl.
*E04H 6/42* (2006.01)
*E04H 6/30* (2006.01)
(Continued)

(52) U.S. Cl.
CPC ..... *E04H 6/424* (2013.01); *E04H 6/04* (2013.01); *E04H 6/182* (2013.01); *E04H 6/183* (2013.01);
(Continued)

(58) Field of Classification Search
CPC ..... E04H 6/422; E04H 6/18; E04H 6/424
(Continued)

(56) References Cited

U.S. PATENT DOCUMENTS 4,968,208 A 11/1990 Friberg
7,123,988 B2 * 10/2006 Russell ..... G06Q 10/08 700/217
7,740,438 B2 * 6/2010 Xiang ..... E04H 6/183 414/227

FOREIGN PATENT DOCUMENTS

CN 202970049 6/2013
CN 106223690 12/2016
(Continued)

OTHER PUBLICATIONS

IT Search Report, dated Nov. 15, 2017, from corresponding IT 201700015512 application.
(Continued)

*Primary Examiner* — Saul Rodriguez
*Assistant Examiner* — Willie Berry, Jr.
(74) *Attorney, Agent, or Firm* — Silvia Salvadori

(57) ABSTRACT

A carriage for handling a vehicle in an automatic parking system includes a frame axially movable along a first longitudinal axis, rotating clamps, each including a pair of counter-rotating arms rotating with respect to a vertical axis orthogonal to both the longitudinal axis and the transverse axis. The carriage includes a transverse-centering unit with transverse pushers, transversely extensible, moving along an axis parallel to the transverse axis and independent of the rotating clamps. In a first retracted position they do not interact with the vehicle wheels. When extended, they come into contact with at least one vehicle wheel. The extensible transverse pushers are on left and right sides of the carriage, and simultaneously move in a symmetrical extension, being operated by a respective motor positioned laterally of the longitudinal axis of the carriage. The extensible transverse pushers include a pantograph for longitudinally aligning the vehicle along the longitudinal axis.

19 Claims, 7 Drawing Sheets

(51) Int. Cl.

| | |
|---|---|
| ***E04H 6/18*** | (2006.01) |
| ***E04H 6/22*** | (2006.01) |
| ***E04H 6/04*** | (2006.01) |
| ***E04H 6/24*** | (2006.01) |

(52) U.S. Cl.
CPC ..... *E04H 6/22* (2013.01); *E04H 6/245* (2013.01); *E04H 6/305* (2013.01); *E04H 6/426* (2013.01)

(58) Field of Classification Search
USPC ..... 414/235, 239, 256, 257
See application file for complete search history.

(56) References Cited

FOREIGN PATENT DOCUMENTS

| | | | |
|---|---|---|---|
| DE | 198 42 084 | A1 | 3/2000 |
| EP | 0 875 644 | A2 | 11/1998 |
| EP | 0 987 384 | A2 | 3/2000 |
| EP | 1 104 831 | B1 | 6/2001 |
| EP | 1 119 673 | B1 | 8/2001 |
| KR | 100 622 553 | B1 | 9/2006 |
| KR | 100 696 296 | A | 3/2007 |
| WO | 2007/110723 | A2 | 10/2007 |
| WO | 2015/177718 | A1 | 11/2015 |

OTHER PUBLICATIONS

Office Action dated Sep. 22, 2020 for corresponding CN patent application No. 201810117067.1.

* cited by examiner

CARRIAGE FOR HANDLING VEHICLES

FIELD OF THE INVENTION

The present invention concerns the field of mechanical automatic parking systems and in detail concerns a carriage for handling vehicles, the carriage being equipped with gripping means having opposing rotating clamps to grip a pair of vehicle wheels.

The present invention also concerns a method of handling vehicles by the use of said carriage.

KNOWN ART

In automatic vehicle parking systems, vehicles are left by the user at an entry/exit room from which they are automatically moved in the parking lot, which is each time assigned to them (stall). This is carried out by means of conveying devices.

It is also known that in said parking systems there are conveying devices generally comprising one or more vehicle-handling carriages, by which the car to be accommodated in or removed from the stall is conveyed. The carriage for handling vehicles is generally installed on a platform moving in vertical and/or horizontal directions, through which it is moved to the required position.

From said position, the carriage is able to convey the vehicle into or from a stall, or again to or from another platform positioned in an exit or entry area where said vehicle can be maneuvered by a user.

The cyclic displacement is always of the back-and-forth type, since the vehicle being parked in a given stall later is always withdrawn therefrom in order to allow its subsequent use.

The following documents describe some carriages of known type, to be used in automated parking systems: U.S. Pat. No. 4,968,208, KR 100696296, KR 100622553, EP 0987384, EP 0875644, EP 1119673, EP 1104831, WO 2007110723, WO 2015177718.

The applicant observed that some carriages of known type, provided with gripping means with opposing rotating clamps to grip a pair of vehicle wheels, (U.S. Pat. No. 4,968,208, KR 100696296, KR 100622553, EP 1119673) are not able to achieve the centering of the longitudinal axis of the vehicle on the longitudinal axis of the carriage, while other carriages (EP 0875644, EP 1104831, WO 2007110723, WO 2015177718) achieve said centering by means of pushing bars to push outwards the vehicle wheels. Due to these pushing elements largely taking up the inner space of the carriage between the pairs of rotating clamps, it is difficult to carry out other operations such as the rotation, translation and lifting of the pair of clamps as well as the translation of the carriage. Different solutions, such as the one adopted in EP 0987384 where, by contrast, the centering is carried out at a later time, after the vehicle has been lifted, by re-aligning the whole vehicle supporting frame with respect to the longitudinal movement axis of the carriage, involve the introduction of an additional device whose complexity is disproportionate to the simple function performed, i.e. the alignment of the vehicle according to the carriage axis. The Applicant, believing that the carriages of the known type solve the problem of centering the vehicle according to the axis of the carriage in such a way as to result in considerable constructive complexity and cost, suggests a simple and compact solution which allows an optimization of the devices and their functions with a reduction in costs although using negligible spaces.

The Applicant further observed that in the known art the problem of positioning a pair of carriages under the car, whereby the transverse axis of a carriage is aligned with the axis of the front vehicle's wheels while the axis of a subsequent carriage is aligned with the axle of the rear wheels, it is not satisfactorily solved. From document EP 1119673 an automated parking system is known and employs a pair of detachably coupled carriages, each mounted on a raisable frame, such as to cause a decoupling of the two carriages—only when the frame of one of the two carriages is raised compared to the other.

The automated parking system according to EP 1119673 has some operational drawbacks, including in particular the dependence of the position of the carriages during the coupling thereof. In particular, it has been found that if one of the two lifting means to lift the frame of one of the two carriages does not work or even is lifted less than the level required for disengaging the coupling means between a carriage and the other, it is absolutely impossible to place the second carriage under the axle opposite to the one on which the first carriage is already located. Moreover, the total time for positioning the pair of carriages under the vehicle is considerably increased since the mobility of the second carriage is possible only after the front wheels of the vehicle have been lifted by the first carriage.

From document EP 0 875 644 an automated parking system is known in which the vehicle is lifted by a pair of carriages in which pressure sensors are deployed on the surface 60 of both carriages in order to measure the vehicle wheelbase, however with the aid of an optical sensor 50 detecting the limit of the front and rear wheels of the vehicle.

Due to the load-cell pressure sensors, together with the optical sensor, the automatic parking system according to EP 0875 644 becomes extremely complex and subject to malfunctions in case of malfunction of any of the pressure sensors or the optical sensor.

In order to align the two carriages under the wheels of the vehicle, the movement effected by the two carriages is complex and involves a return of the carriage which is positioned under the rear wheel towards the coming direction thus resulting in an increase in the time required for the positioning.

Therefore, the applicant found the need to have an automated parking system, which comprises a pair of carriages able to be positioned each under a respective axle of a vehicle, and which is flexible as regards the ability to transport vehicles whose wheelbases have noticeably different measures from one another, and which provides the maximum simplicity in handling the movement of the two carriages.

Therefore the object of the present invention is to describe an automated vehicle parking system which allows the aforementioned drawbacks to be solved.

It is a further object of the present invention to describe a method of handling vehicles in an automatic parking which allows the aforementioned drawbacks to be solved.

SUMMARY OF THE INVENTION

According to the present invention a carriage for handling a vehicle in an automatic parking system is made, said carriage comprising a frame axially movable along a first longitudinal axis, rotating clamp elements wherein each of said rotating clamp elements comprises, per each side of the carriage, a pair of counter-rotating arms which rotate with respect to a vertical axis orthogonal to both said longitudinal axis and said transverse axis, said carriage being characterized by comprising transverse-centering means which comprise a pair of transverse pushers, which are transversely extensible, move along an axis parallel to or coincident with said transverse axis and are independent with respect to said rotating clamp elements, said means comprising a first retracted position in which they do not interact with the wheels of said vehicle and at least one more extended position in which they come into contact with at least one vehicle wheel; said extensible transverse pushers are arranged on the left side and on the right side of said carriage, and simultaneously move in a symmetrical extension, being operated by a respective motor positioned laterally with respect to the longitudinal axis of said carriage, and wherein said extensible transverse pushers comprise a pantograph for longitudinally aligning said vehicle along said longitudinal axis. According to a first preferred and non-limiting aspect of the present invention, said respective motor is installed on said carriage so that a rotation axis of the respective shaft is oriented substantially parallel to the longitudinal axis of the carriage itself, and wherein said respective motor is positioned in substantial proximity to a side crosspiece of the carriage itself.

According to a further preferred and non-limiting aspect of the present invention, said rotating clamp elements cause the position of the transverse axis of the carriage to be aligned with the axis of the wheels.

According to a further preferred and non-limiting aspect of the present invention, said alignment is carried out by rotating said rotating clamp elements engaging the wheels and simultaneously releasing the brake of the driving motor to drive the carriage in the longitudinal direction.

According to the present invention, an automated parking system is described which comprises a pair of vehicle-handling carriages, characterized in that:

said pair of carriages is designed to approach a vehicle along a direction substantially corresponding to a longitudinal movement axis, thus identifying in said pair of carriages a first carriage nearer to said vehicle and a second carriage farther from said vehicle;

there is a first arrangement in which said second carriage is completely outside the contour of said vehicle and opens the arms which are longitudinally farther with respect to a destination point of said second carriage and positioned on the opposite sides thereof while said first carriage moves forward at least partially under said vehicle thus reaching the latter with the arms substantially aligned with said longitudinal axis;

there is a second arrangement in which said second carriage having said arms open comes into contact with the tires of said vehicle while said first carriage is at an intermediate position between two axles of said vehicle and opens said its own arms longitudinally farther with respect to a destination point of said carriage; said first and said second carriages are independent of one another.

According to a further preferred and non-limiting aspect of the present invention, said system is characterized by comprising an initial arrangement in which said first and second carriages are both outside the contour of said vehicle and have arms substantially aligned with said longitudinal axis, and wherein the distance between said first and said second carriages changes between said initial arrangement and said first or second arrangement.

According to a further preferred and non-limiting aspect of the present invention, said extensible transverse pushers are activated after the moment in which said arms, which are longitudinally farther from a destination point of said carriage, are in contact with said wheel.

According to a further preferred and non-limiting aspect of the present invention, there are adjusting means to adjust the linear translation speed of said first and/or second carriages along said longitudinal axis.

According to the present invention a method of actuating a pair of carriages for handling a vehicle in an automated parking system is further described, in which said pair of carriages are adapted to insert themselves at least partially under said vehicle and in which each carriage of said pair comprises rotating clamp elements which in turn comprise a pair of counter-rotating arms on a pair of sides of said carriage, said method comprising:

an approaching step wherein said vehicle is approached by a pair of vehicle-handling carriages along a direction substantially coincident with a longitudinal axis of the vehicle itself, wherein, in said approach, a first carriage closer to said vehicle and a second carriage farther from said vehicle and independent of said first carriage are identified;

an actuating step to actuate said rotating clamp elements of said second carriage, and wherein said actuating step comprises opening the arms longitudinally farther from a destination point of said second carriage;

a stopping step to stop said second carriage when said arms longitudinally farther with respect to said destination point of said second carriage come into contact with the wheels of an axle of the vehicle which is closer to said second carriage; and a pursuing step to pursue the travel of said first carriage under said vehicle, the step comprising opening said pair of arms longitudinally farther with respect to the destination point of said first carriage when the latter is at an intermediate position between the first and the second axles of the vehicle; and an operating step to operate a pair of transverse pantograph-like pusher means, independent with respect to said rotating clamp elements and installed on board said first and said second carriages, in which step the longitudinal axis of the vehicle is aligned with a movement axis of at least one of said first or second carriage.

According to a further preferred and non-limiting aspect of the present invention, the operation of said pair of transverse pushers comprises their symmetrical operation with respect to said movement axis, and comprises a movement along an axis parallel to or coincident with said transverse axis, from a first retracted position in which said transverse pushers do not interact with the wheels of said vehicle to a second extended position, in which they interact with at least one wheel of said vehicle.

According to a further preferred and non-limiting aspect of the present invention, said actuation of said pair of transverse pushers comprises causing an outer end portion of at least one of said transverse pushers to carry out a movement, said movement causing them to come into contact with a transversely misaligned wheel of said vehicle, during the extension towards said second position.

According to a further preferred and non-limiting aspect of the present invention, in said method there is a step of further extending towards at least one second extending position in which at least one of said transverse pusher elements, during the interaction, transversely pushes said wheel up to a position which forces at least one axle of said vehicle to be transversely centered with respect to said longitudinal axis of said carriage.

According to a further preferred and non-limiting aspect of the present invention, said actuation of said transverse pushers comprises an elongation or a shortening of said pantograph along said transverse axis.

According to a further preferred and non-limiting aspect of the present invention, said activating step of said transverse pushers takes place concurrently with an actuating step of said rotating clamp elements.

According to a further preferred and non-limiting aspect of the present invention, said activating step of said transverse pushers takes place after the activation of said rotating clamp elements.

More particularly, said rotation of said rotating clamp elements, together with the concomitant release of the brake of the driving motor to drive the carriage in the longitudinal direction, leads to the longitudinal movement by reaction of the carriage thereby causing the transverse symmetry axis of the carriage clamps to align with the transverse axis of the two wheels of the vehicle and causing said transverse pushers to apply the push to the center of said two wheels of the vehicle.

According to a further preferred and non-limiting aspect of the present invention, said activating step to activate said transverse pushers comprises a guiding step to guide an actuating belt or chain by rotating sprocket wheels which are engaged thereon, wherein said drive belt or chain engages gears that transversally extend said transverse pushers and wherein said actuating step to actuate said transverse pushers comprises the actuation of a worm screw guiding the extension of said pantograph.

According to the present invention:

"longitudinal direction" or "longitudinally" means a direction generally heading in the movement direction of the carriage guide wheels, which direction being or substantially being the longitudinal axis of the vehicle.

"transverse direction" or "transversely" means a direction with an angle substantially orthogonal to the longitudinal axis of the carriage; and "compound movement" means a combined movement, carried out substantially at the same time, of a plurality of parts of the vehicle-conveyor carriage.

"independent carriages" or "pair of independent carriages" means that said carriages are mechanically separate, in particular in such a way that their mutual distance can vary without releasing mechanical on-board means which would otherwise constrain the relative position of said joining means.

DESCRIPTION OF THE FIGURES

Further aspects concerning the carriage and the method disclosed herein in the preceding paragraph will be better clarified in the subsequent part of the description and referring to the accompanying figures, in which.

DETAILED DESCRIPTION OF THE INVENTION

As shown in FIGS. 1-5, the carriage object of the present invention comprises a frame in which there is a shaft 1 controlling the lifting of a pair of rotating clamp elements 3, 4, 6, 7 arranged on the two sides of the carriage object of the present invention. This carriage is designed to move preferably along a longitudinal path, i.e. along an axis X so as to be able to pass below the chassis of the vehicle within the gauge of the vehicle itself.

Figure 1:
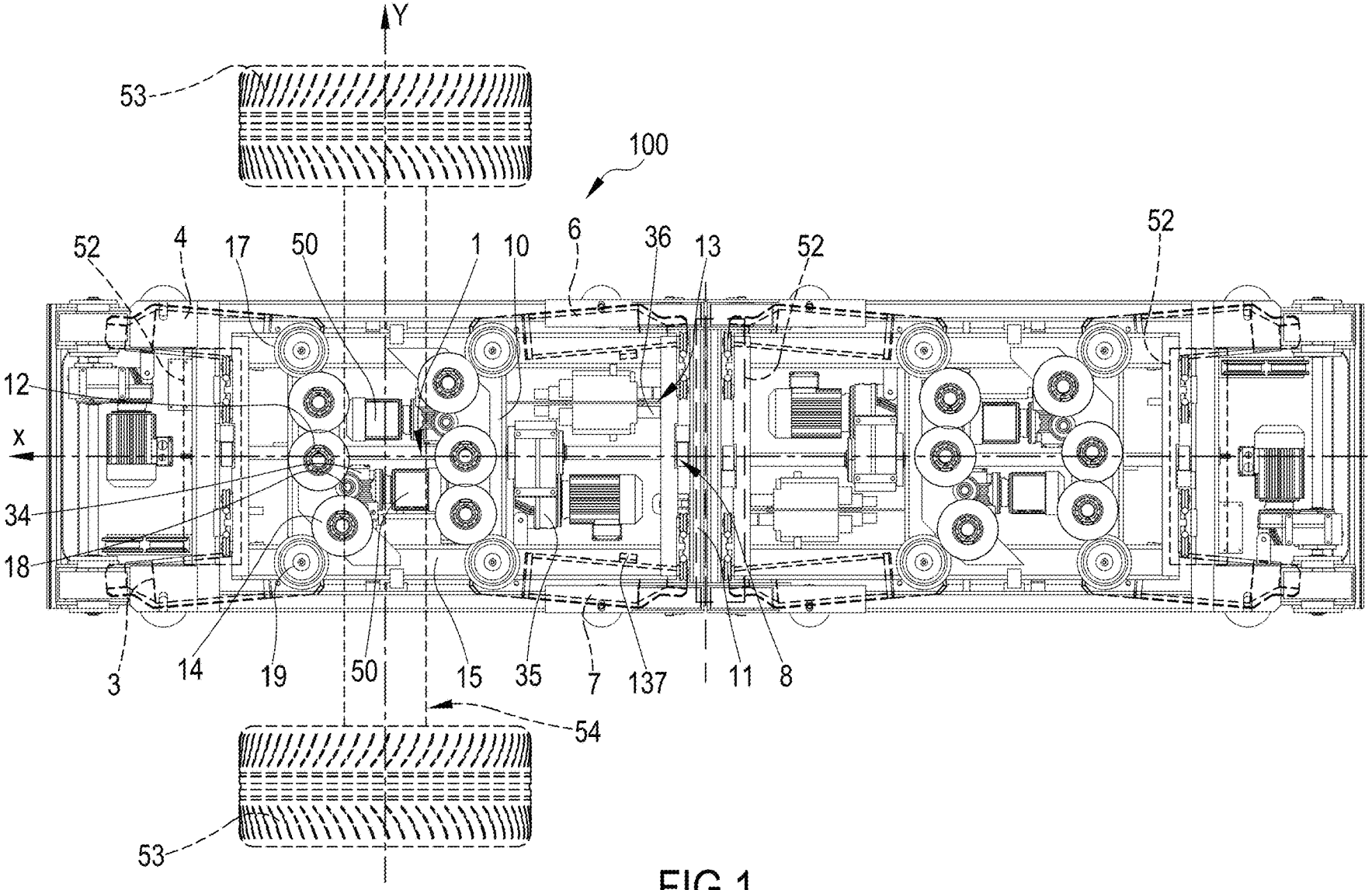
FIG. 1 shows a top view of a pair of vehicle-handling carriages in an automated parking system.
Figure 2:
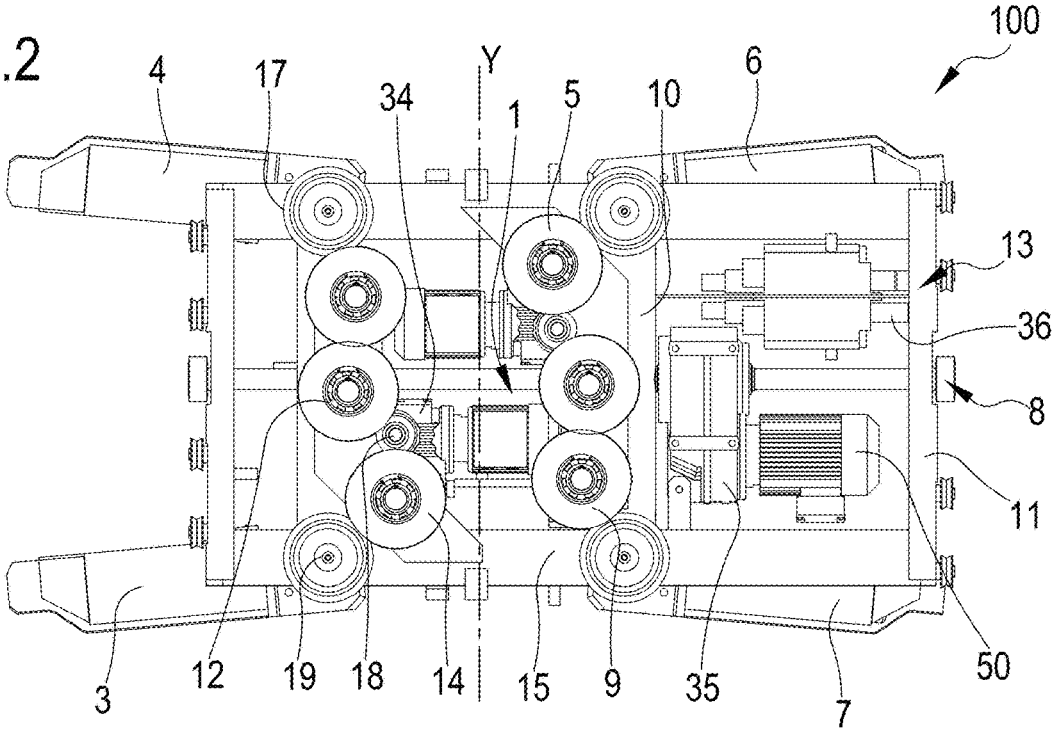
FIG. 2 shows a bottom view of one of the carriages of FIG. 1.
Figure 3:
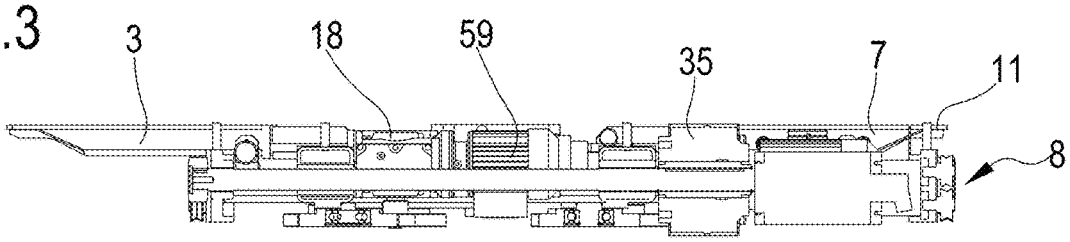
FIG. 3 shows a side view, partially cut-away, of the carriage of FIG. 2.
Figure 4:
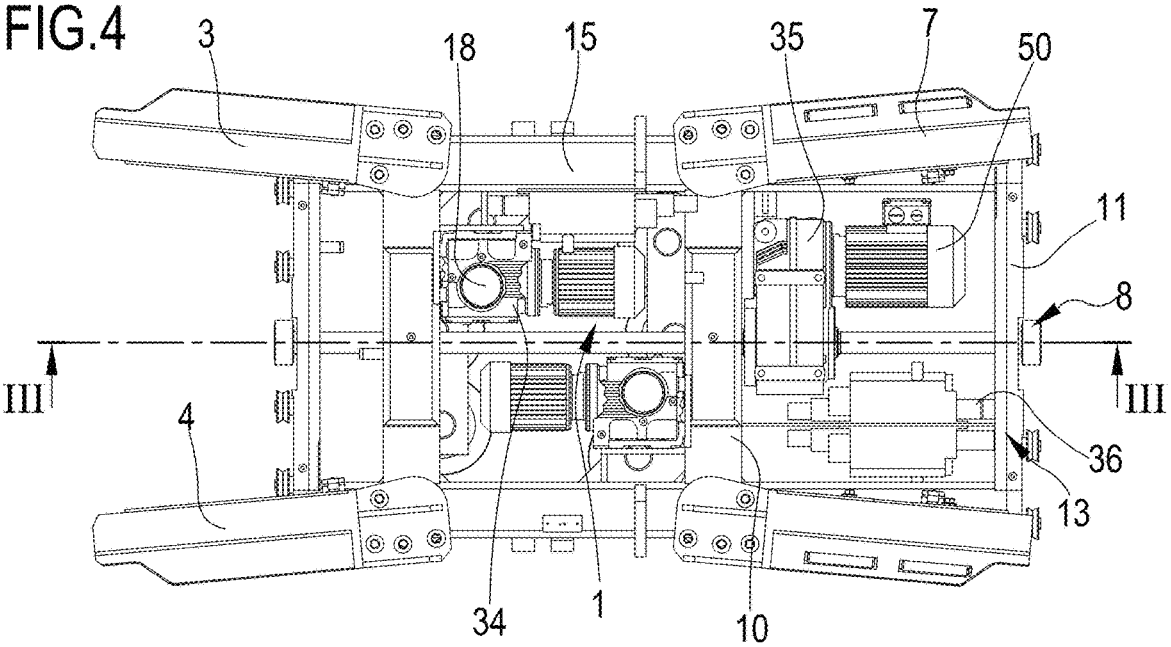
FIG. 4 shows a top view of one of the carriages of FIG. 1.

FIG. 1 shows a pair of carriages arranged so as to be axially aligned along a longitudinal axis X.

The rotating clamp elements 3, 4, 6, 7 are operated two by two by respective electric actuators 34 which preferably, but not exclusively, comprise an electric motor. The electric motor operates the rotating clamp elements 3, 4, 6, 7 by means of a plurality of gears 5, 18, 9, 17.

Each pair of rotating clamp elements comprises a pair of arms 3, 6; 4, 7 counter-rotating with respect to each other and having a rotation axis parallel to a vertical axis Z.

The longitudinal distance of the rotating clamp elements is appropriate for locking the wheels of a vehicle whose rim diameters are between 15 and 20 inches. The arms of the rotating clamp elements lock the vehicle wheels in low position, at a level lower than that at which the wheel's rotation axis lies.

Moreover, the rotating clamp elements are designed to allow the transverse symmetry axis (Y) of the clamps of the carriage object of the present invention to be aligned with the transverse axis of the two wheels of the vehicle 54.

Per each side of the carriage, the rotating clamp elements are simultaneously actuated by actuating means comprising a single electric motor 50. As an alternative, in an embodiment not described in the accompanying figures, both the rotating clamp elements can be actuated by a single motor or else, alternatively, each of their arms can be operated by a respective motor. The latter solution involves a simultaneous actuation control of the arms for each rotating clamp element.

In use, when the axle 54 of the vehicle is positioned substantially between the arms, their rotation causes at least one of them to first come into contact with the vehicle wheel; at this point, after having temporary released the brake of the driving motor to drive the carriage in the longitudinal direction, a further rotation of the arms themselves in the same previous direction causes the carriage to move along the longitudinal axis X, up to a point where both arms of the rotating clamp element come into contact with the wheel so as to align the axis Y with the transverse axis of the two wheels of the vehicle 54. The carriage object of the present invention further comprises a pair of transverse pushers 205, 206 which are transversely extensible; these transverse pushers 205, 206 are respectively arranged on the left and right sides of the frame and are controlled independently with respect to the clamp elements 3, 4, 6 7; in particular, they are controlled by their own motor, while the clamp elements 3, 4, 6, 7 are controlled by their own motors distinct from the preceding one.

"Transversely extensible", according to the present invention means that these elements extend between at least one first and one second operational position in a direction transverse, and more precisely orthogonal, to the direction defined by the longitudinal axis X of the vehicle, thus lying in a direction parallel to the one defined by the transverse axis Y.

In detail, each of said transverse pushers 205, 206 comprise a pantograph 205 whose first end is installed at the frame on a worm screw rotating with respect to the frame itself. The pantograph 205 also has a second end opposite to said first end, instead arranged at a roller 206 rotating on an axis parallel to the axis X.

In a preferred and non-limiting embodiment, the transverse axis Y is also the axis on which the pantograph 205 extends. In this way, it is ensured that when the wheel is centered on said transverse axis Y, the force the rollers 206 apply against the vehicle tire is balanced with respect to the reaction due to the friction between the tire and the surface on which the latter rests.

The roller 206 is designed to come into contact with the shoulder of the tire without damaging it, and is therefore adapted to apply a thrust force which allows the centering of the vehicle with respect to the longitudinal axis X of the carriage.

As shown in the accompanying figures, transversely-extendible transverse pushers 205, 206 move with simultaneous motion both on the left side and the right side. The applicant found that this solution is the best compromise in the actuation of the pusher elements, a single motor 201 being required for the operation. Advantageously this single motor 201, designed to operate only the transverse pushers 205, 206, is installed laterally with respect to the longitudinal axis of the carriage, substantially near the crosspiece thereof. In this way, greater flexibility in the design of the same is provided, and the transverse pushers are prevented from being handled through solutions particularly complex and less precise than the highlighted one. Advantageously, moreover, the motor 201 is a motor which operates the transverse pushers by a drive without mutual decoupling means, such as for example clutches, which could wear out over time.

Advantageously, the axis of the motor 201 is maintained parallel to the longitudinal axis of the carriage. This not only makes it possible to further reduce the transverse dimensions of the motor, but also contributes to keep the flexibility in the design of the remaining parts of the carriage itself.

The transverse pushers 205, 206 move independently with respect to the rotating clamp elements, which are therefore driven by their own actuating means. In this way, it is possible not only to have at least two carriage-operation options, but also to advantageously avoid the centering operation of the vehicle on the longitudinal axis X if it is not required, for example when withdrawing the vehicle from the parking stall. The applicant points out that this releasing operation is not possible when a compound movement is carried out through a single actuator.

A first control option is the simultaneous rotation of the rotating clamp elements together with a transverse extension of the transverse pushers 205, 206; by contrast, the other option provides for actuating the rotating clamp elements and subsequently, i.e. when the wheel is symmetrically centered with respect to the transverse axis Y, actuating the transverse pushers 205, 206 in order to allow the axle 54 of the vehicle to be positioned at a symmetrically centered position also with respect to the longitudinal axis X.

If the option of simultaneously rotating the rotating clamp elements and at the same time transversely extending the transverse pushers 205, 206 is carried out, then the overall movement they describe is a complex and separate movement of biaxial alignment of the vehicle axle 54 along two orthogonal axes.

Figure 5:
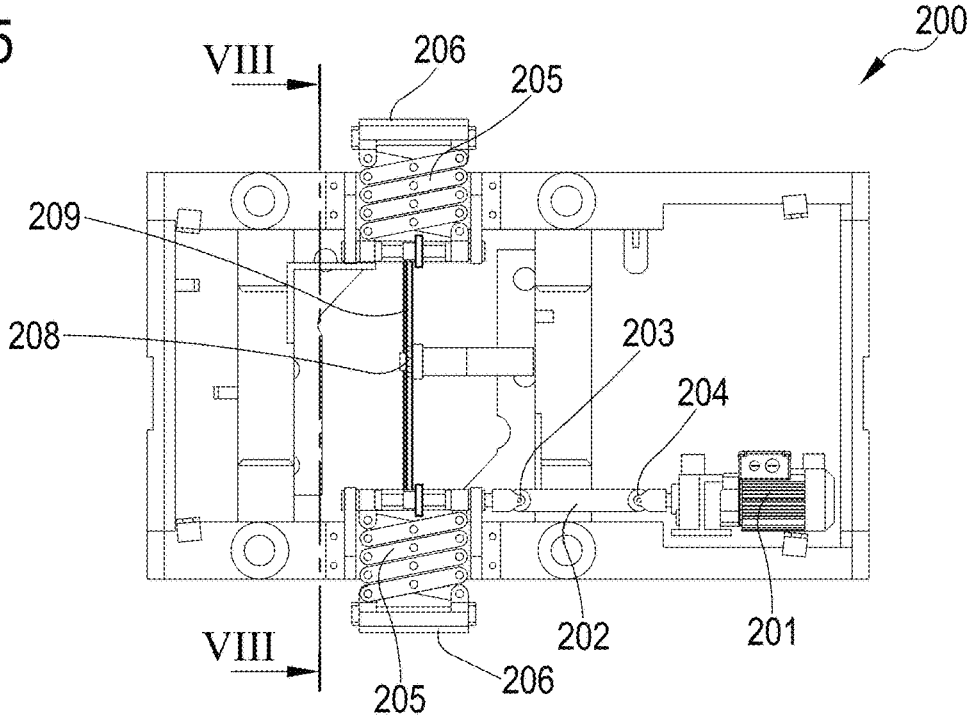
FIG. 5 shows a top view of part of the carriage object of the present invention, comprising transverse centering means designed to align the vehicle axle on a longitudinal axis of the carriage, and wherein said transverse centering means are shown in a first operational position in which they extend by a minimum amount outside the profile of the carriage frame.
Figure 6:
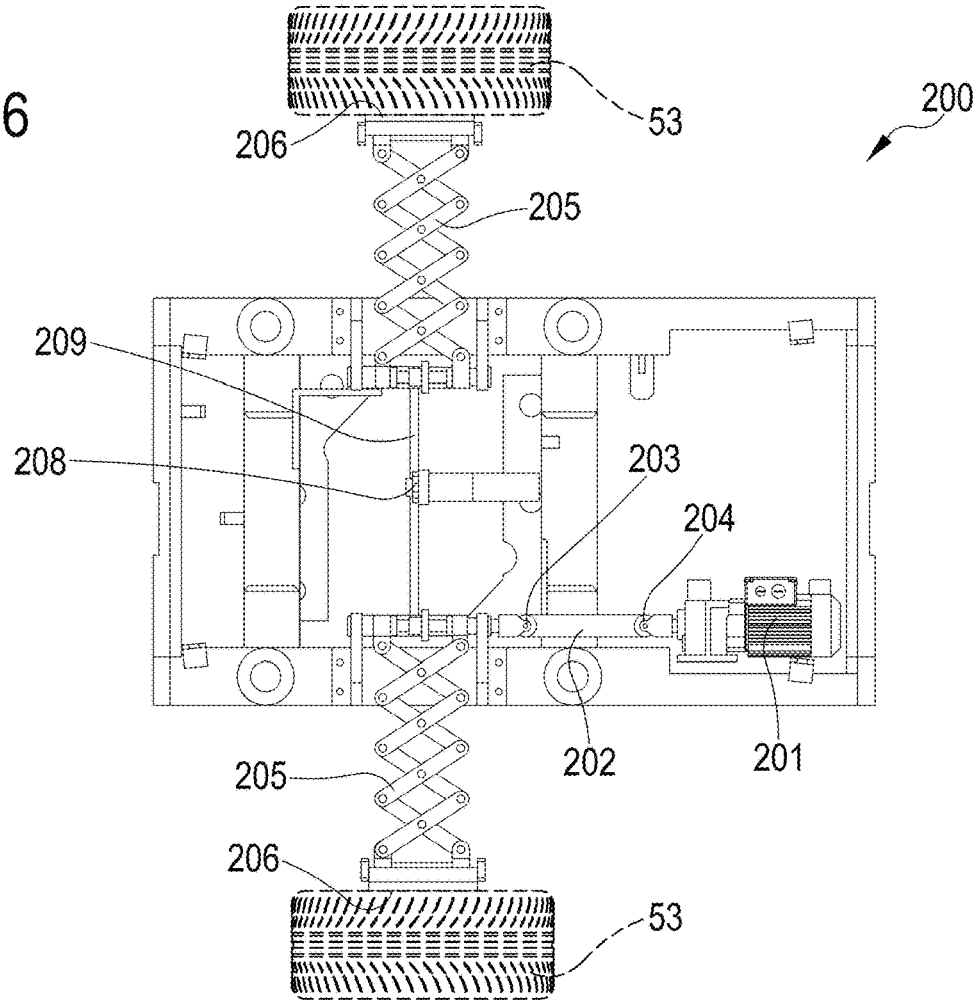
FIG. 6 shows a top view of part of the carriage according to the present invention, comprising transverse centering means designed to align the vehicle axle along a longitudinal axis of the carriage and wherein said transverse centering means are shown in a second operational position in which they extend outside the profile of the carriage by a greater amount with respect to what shown in FIG. 6.
Figure 7:
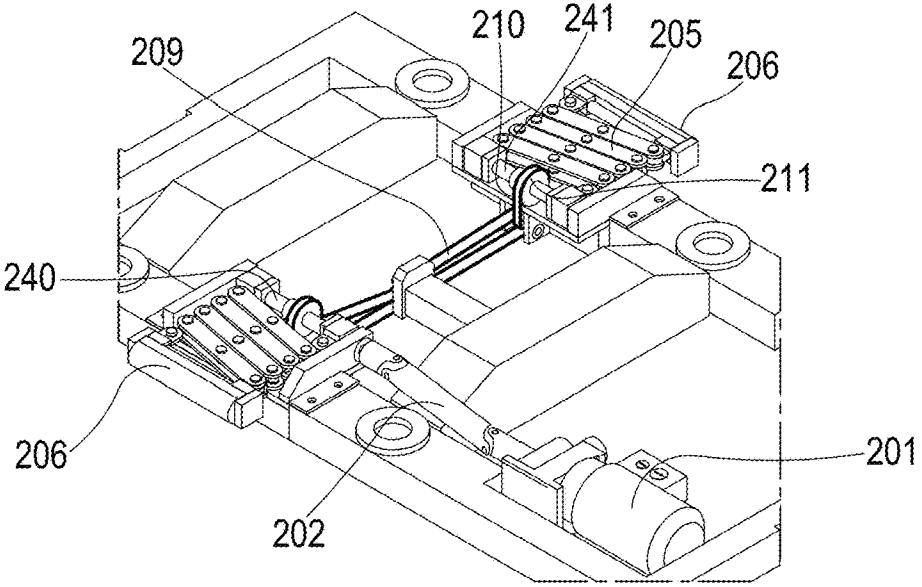
FIG. 7 is a partial perspective view of the carriage according to the present invention.
Figure 8:
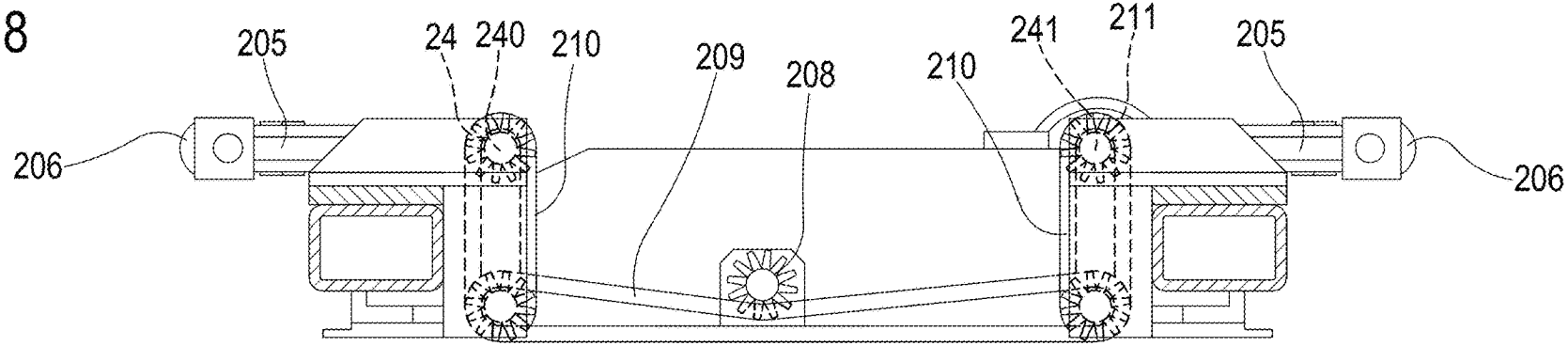
FIG. 8 relates to a sectional view of the carriage of FIG. 5, along the lines A-A.

As shown in FIG. 7 and FIG. 8, the transverse pushers 205, 206 are simultaneously actuated by means of a plurality of gears, belts and chains. In detail, the first end portion of the pantograph 205 is installed on the worm screw 240, 241 comprising a thread which turns out to be partially clockwise and partially counterclockwise. Two connecting means (nut screws), having a through-hole with a reverse-thread with the same pitch as the worm screw, are installed respectively at the clockwise-threaded portions and the counterclockwise-threaded portions. When the worm screw is actuated the connecting means move either axially close to or axially away from each other, depending on the rotation direction. If they come close, then they cause the pantograph 205 to axially extend along a transverse axis Y (shown in FIG. 6). On the contrary, if they move away, then they cause the pantograph 205 to axially contract along said transverse axis Y (as shown in FIG. 5).

Therefore, when the pusher elements 205, 206 are actuated according to the present invention, they can take at least two operating positions characterized by different axial extensions:

a first extended position in which at least one of the two rollers 206 comes into contact with the tire of a longitudinally misaligned vehicle; and a second extended position in which one of the two rollers 206 pushed outward the tire of a vehicle axle so as to center it and, in particular, causing the midpoint of the axle 54 to be aligned on the longitudinal axis X. Theoretically, in the second extended position, both the rollers 206 touch the wheels 53 of the vehicle axle 54.

The rollers 206 may be equivalently replaced by gripping means designed to generate sliding friction with the tire shoulder in order to reduce the risk of the vehicle slipping in a direction defined by the longitudinal axis X. In this way, greater alignment accuracy is ensured.

As shown in FIG. 8, at the end portions of said worm screw, there are first coupling sprocket wheels 211 which are connected to second coupling sprocket wheels positioned at a lower level. These first and second coupling wheels are connected through a chain 210 which, in an alternative solution, can be equivalently replaced by toothed belts or directly engaged gears.

The second coupling sprocket wheels meshes with a toothed belt 209 or chain which also engages on a tensioning pinion 208. The worm screw 240, 241 is connected to the controlling motor 201 through a drive shaft 202 provided, at its end portions, with a pair of universal joints 203, 204.

By means of said drive shaft 202, said worm screws 240, 241 with the respective nut screws and said idler means 209, 210 and 211, said motor 201 simultaneously controls the transverse pushers 205 and 206 of both sides of the carriage so as to extend them outward or contract them along the axis Y. In particular, the axis of the sprocket wheels is parallel to the longitudinal axis of the carriage thereby allowing a substantially direct coupling with the controlling motor 201, in particular without transmissions by bevel wheels. In the embodiment with second coupling sprocket wheels positioned at a lower level with respect to the first coupling sprocket wheels, at least part of the actuating system can be at a lower level with respect to the transverse pushers 205, 206, so that greater free space is available at the upper portion of the carriage and the center of gravity of the latter is lowered.

If two carriages are juxtaposed, as shown in FIG. 1, they can be operated so as to cause a biaxial centering of both axles 54 of a vehicle.

In a first operational arrangement, the carriage moves first along the longitudinal axis X in order to reach a position under the vehicle approximately such that the vehicle axle 54 is close to the transverse axis Y of the carriage. Although the vehicle can be axially misaligned with respect to the longitudinal axis of the carriage, the latter has no possibility of transverse translation, being able—in the translation phase under the vehicle—to only move along a longitudinal and linear direction.

At this point, the rotating clamp elements are actuated so as to lock the wheels 53 of the axle 54, thereby causing said axle 54 to coincide with the transverse axis Y. At this point, the transverse pushers are actuated in order to transversely center the vehicle along the longitudinal axis X as well.

When the counter-rotating arms of the clamp elements have firmly locked the vehicle axle 54, actuating means 59 comprising at least one electric motor provide the actuation of rack-and-pinion lifting means to lift the carriage 52. These carriage lifting means have enough force to allow the carriage and vehicle to be lifted together, so that this assembly can be moved towards the stall where the vehicle is then parked.

In an alternative embodiment, the carriage first moves along the longitudinal axis X in order to arrive under the vehicle in a first position approximately coincident with the vehicle axle 54, which is therefore next to but still not coincident with the transverse axis Y.

At this point, the rotating clamp elements are actuated in order to provide partial alignment of the wheels 53 of the axle 54, causing the axle of the vehicle 54 to be more in contact with the transverse axis Y.

The rotating clamp elements, until now, are not completely closed so as to lock the vehicle wheels.

Then the transverse pushers are actuated in order to transversely center the vehicle on the axis X, and only in that moment the rotating clamp elements are again actuated to be closed in order to complete the locking of the wheels of the vehicle 53.

The carriage object of the present invention is integrated in a context of an automated parking lot having an innovative handling process or method and comprising at least one pair of carriages for handling vehicles, the carriages being powered and controlled from the outside by known means. The movement of the pair of carriages with respect to the vehicle 400 will be described hereinafter with reference to FIGS. 9-14 attached to the present description.

Figure 9:
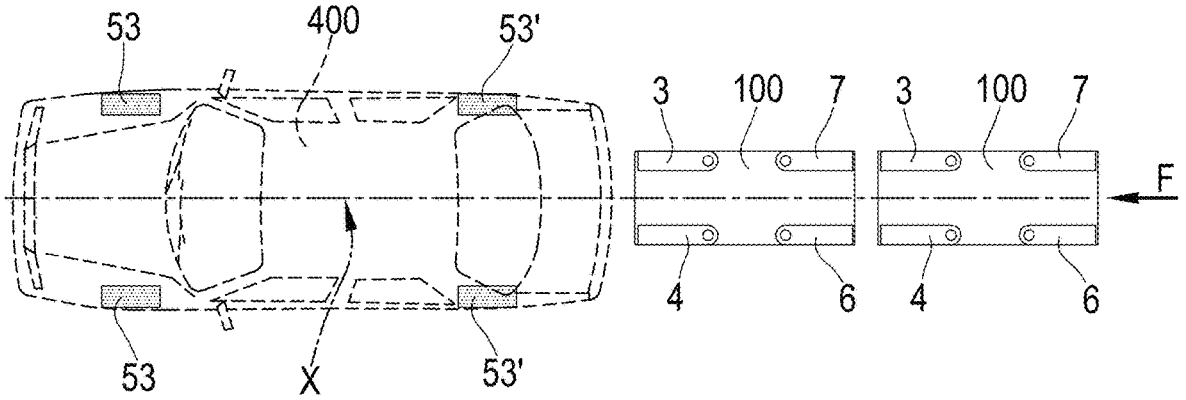
FIG. 9 shows a first arrangement of a first pair of carriages approaching a vehicle during a handling operation of the carriages themselves, object of the present invention.
Figure 10:
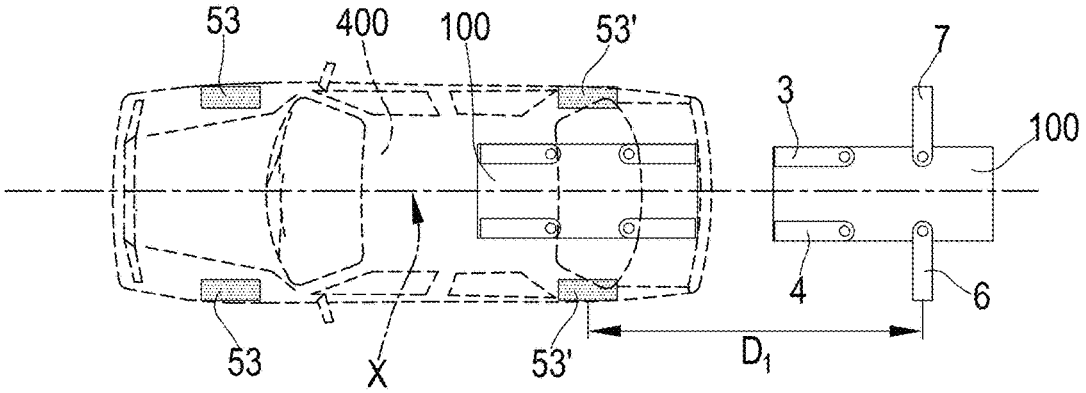
FIG. 10 shows a second arrangement of the pair of carriages of FIG. 9, in particular at a moment following the one in which the first pair of carriages is shown in the same FIG. 9.
Figure 11:
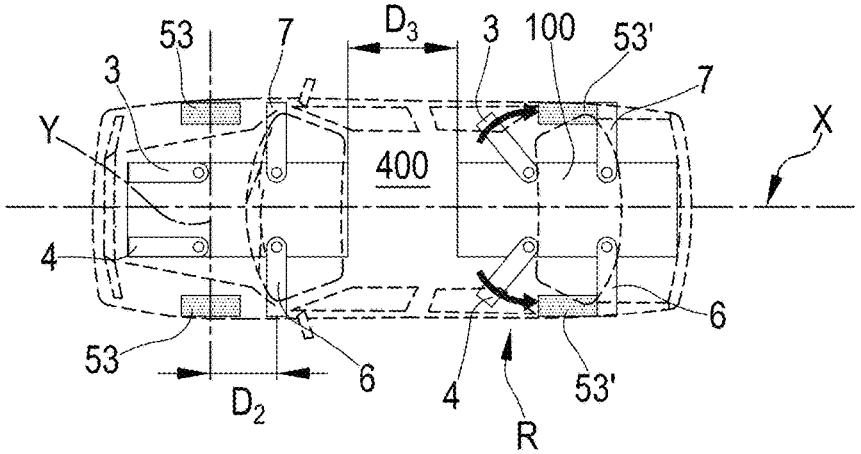
FIG. 11 shows a third arrangement of the pair of carriages of FIG. 9, in particular at a moment following the one in which the first pair of carriages is shown in FIG. 10.

In detail, FIGS. 9-11 show a time sequence of positions, in particular a first, second and third arrangements, of a pair of carriages which are operated in a single handling procedure in order to be able to withdraw the vehicle 400 from a parking bay or a time-stay station. FIGS. 9-11 show in detail a sequence in which the carriages 100 approach the vehicle from a rear direction. This approaching direction should not be intended as a limitation, since it is equally possible to approach the vehicle from the front. This advantageously provides the system described herein with great flexibility of installation arrangements.

In the approach along the front direction as well as in the approach along the rear direction, both substantially linear and substantially coincident with the direction identified by the longitudinal axis X, the pair of carriages 100 defines a first carriage closer to the vehicle 400 and a second carriage more remote with respect to the vehicle. Both carriages move in linear translation along a predefined path up to a mutual destination point at the respective axle of the vehicle to be lifted.

Although the carriages are operated in a single handling procedure, the two carriages object of the present invention move independently, i.e. they are not constrained relative to one another by any mechanical constraining means—even temporary or removable—able to make their mutual distance mechanically locked even only temporarily.

As illustrated in FIG. 9, in a starting arrangement the two carriages 100 object of the present invention approach the vehicle from a rear direction, moving forward at a predetermined translation speed by their own motor means. During the first approaching step, the first front carriage and the second rear carriage move closer to one another, remaining coordinated at a distance measured on the axis X which is substantially constant, although not adjusted by mechanical means, thus maintaining a mutual independence.

As shown in FIG. 10, progressively the first of the two carriages initially arrives near and successively under the vehicle 400, while the second carriage 100, aligned to the first one, is still completely outside the contour of the vehicle itself. Here, after a preset time from the start, the second carriage 100 more remote with respect to the vehicle 400 is arranged so that the arms 6, 7 on the left and right sides of the carriage are operated to move from a first position substantially parallel to said longitudinal axis X to a second position wherein they are substantially orthogonal with respect to the first one and therefore are such as to start countering with the wheels 53' of the rear axle of the vehicle 400. The position at which these arms are operated is depicted in figure with by distance $D_1$ from the wheel axis of the rear axle of the vehicle 400 and is preferably, but not limited to, at least 1 m. The second carriage 100 stops and the motorized means, which control the linear translation thereof, are stopped by known sensor means, for example by checking the current absorption of the carriage propelling motor or, alternatively, by means of pressure sensors, limit elements or load cells placed on the arms themselves.

As illustrated in FIG. 11 when the second carriage 100 is stopped, also the first carriage 100, which is already under the vehicle 400, is arranged in such a way that the arms 6, 7 on the left and right sides open to reach a position substantially orthogonal to the longitudinal axis X. The position in which the first carriage is controlled so as to operate the opening of the arms 6, 7, is depicted in figure by the distance $D_2$ from the wheel axis 53 of the front axle of the vehicle 400. This distance D2 is preferably, but not limited to, 0.3 m or less. During this step, the first carriage progressively moves away from the second carriage 100 which is now stationary against the rear axle 53'. The motor means of the first carriage 100 are also stopped when the arms 6, 7 longitudinally farther from the destination point of said first carriage come into contact with the wheels 53 of the front axle and this occurs again by known means, such as by checking the current absorption of the carriage propelling motor or alternatively by pressure sensors, limit elements or load cells placed on the arms themselves.

Figure 12:
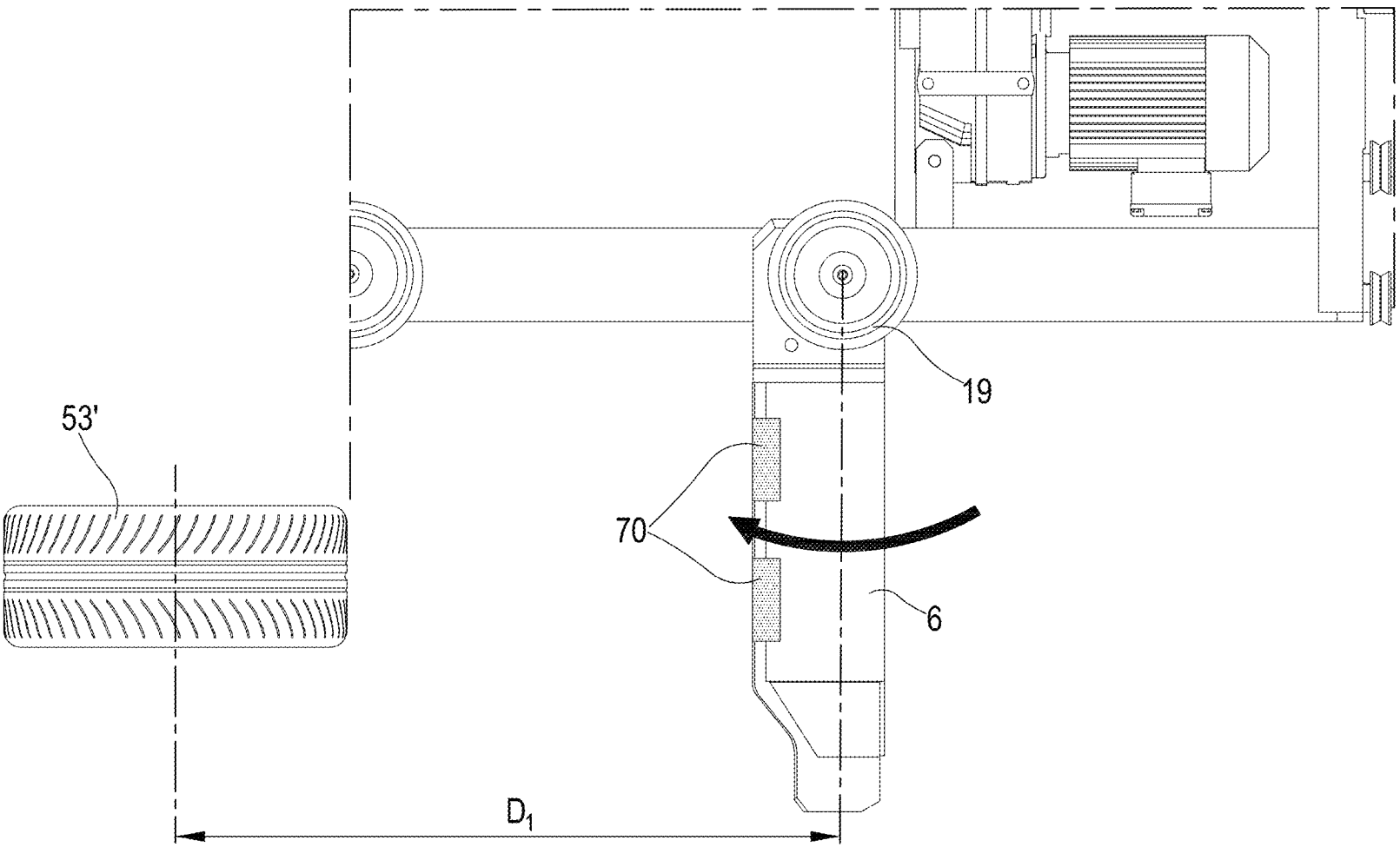
FIG. 12 shows a detail of a portion of the carriage object of the present invention near a vehicle wheel.

As schematically shown in FIG. 12, optionally, as the arms 6, 7 approach the respective wheels 53, 53', the speed of the carriage 100 can be linearly reduced until reaching the contact point between the arm and the wheel itself The linear reduction of the speed of the motor means takes place by means of a control of known type.

Figure 13:
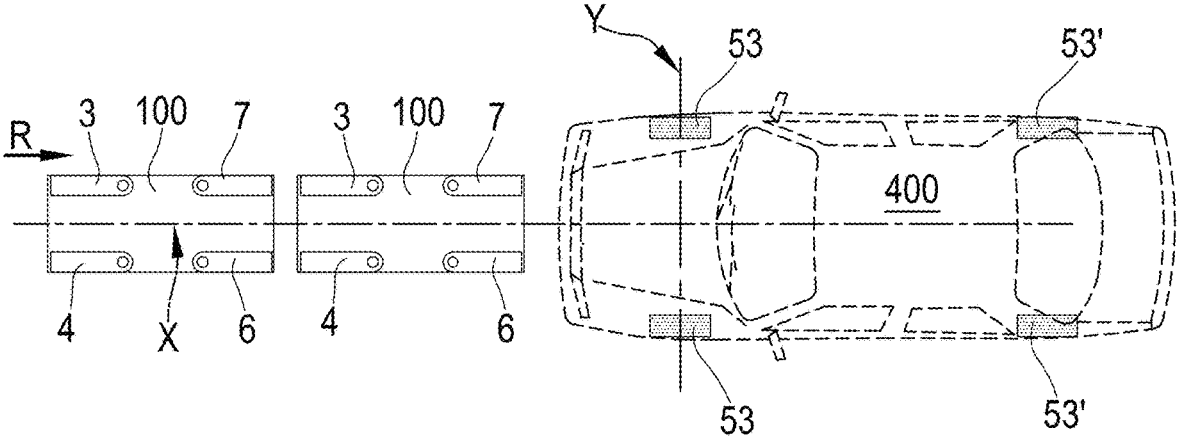
FIG. 13 shows a fourth arrangement of a first pair of carriages approaching a vehicle during a handling operation of the carriages themselves, object of the present invention.
Figure 14:
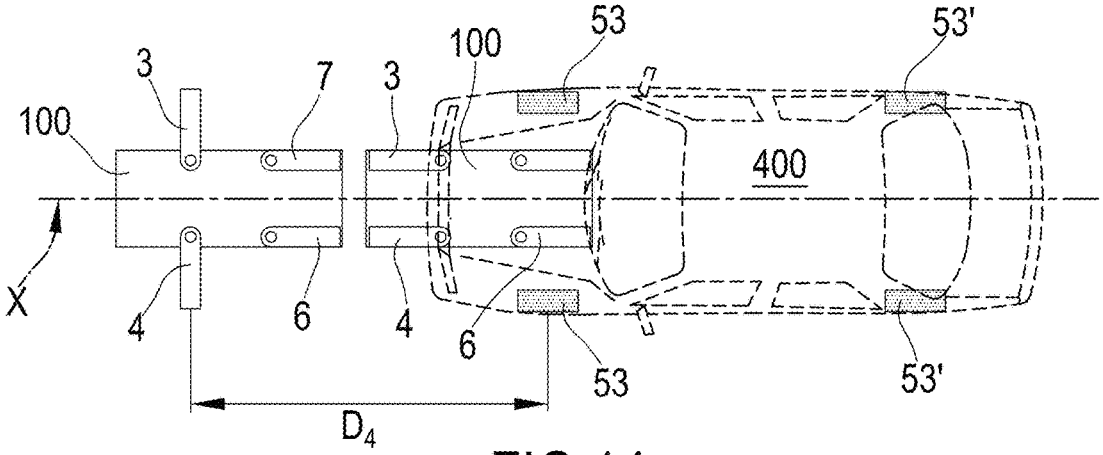
FIG. 14 shows a fifth arrangement of the pair of carriages of FIG. 13, in particular at a moment following the one in which the first pair of carriages is shown in the same FIG. 13.
Figure 15:
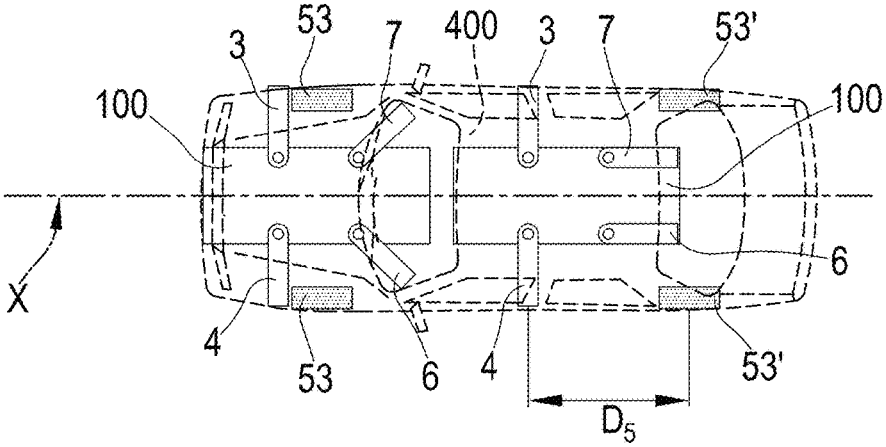
FIG. 15 shows a sixth arrangement of the pair of carriages of FIG. 13, in particular at a moment following the one in which the pair of carriages is shown in FIG. 14.

As shown in FIGS. 13-15, the approach of the two carriages 100 to the vehicle 400 can also take place from the front of the vehicle itself The arrow R of FIG. 13 identifies the linear direction of the translation of the pair of carriages 100 towards the rear portion of the vehicle 400. In this case, the arrival point of the first carriage 100 is the rear axle of the vehicle, while the arrival point of the second carriage 100 is in this case the front axle of the vehicle.

As illustrated in FIG. 13, in a starting arrangement the two carriages 100 object of the present invention approach the vehicle from a front direction, moving forward at a predetermined translation speed by their own motor means. During the first approaching step, the first front carriage and the second rear carriage move closer to one another, remaining coordinated at a distance measured on the axis X which is substantially constant, although not adjusted by mechanical means, thus maintaining a mutual independence.

As shown in FIG. 14, progressively the first of the two carriages initially arrives near and successively under the vehicle 400, while the second carriage 100, aligned to the first one, is still completely outside the contour of the vehicle itself.

Here, after a preset time from the start, the second carriage 100 more remote with respect to the vehicle 400 is arranged so that the arms 3, 4 on its left and right sides are operated to move from a first position substantially parallel to said longitudinal axis X to a second position wherein they are substantially orthogonal to the first one and are therefore such as to start interfering with the wheels 53 of the front axle of the vehicle 400. The position at which these arms are operated is depicted in figure by the distance $D_4$ from the wheel axis of the front axle of the vehicle 400, and is preferably, but not limited to, at least 1 m. The second carriage 100 stops and the motorized means, which control the linear translation thereof, are stopped by known sensor means, for example by checking the current absorption of the carriage propelling motor or, alternatively, by means of pressure sensors, limit elements or load cells placed on the arms themselves.

As illustrated in FIG. 15 when the second carriage 100 is stopped, also, the first carriage 100, which is already under the vehicle 400, is arranged in such a way that the arms 3, 4 on the left and right sides open to reach a position substantially orthogonal to the longitudinal axis X. The position in which the first carriage is controlled so as to operate the opening of the arms 3, 4, is depicted in figure by the distance $D_2$ from the wheel axis 53 of the rear axle of the vehicle 400. This distance $D_5$ is preferably, but not limited to, 0.3 m or less. During this phase, the first carriage progressively moves away from the second carriage 100 which is now stationary against the front axle. The motor means of the first carriage 100 are also stopped when the arms 3, 4 longitudinally farther from the destination point of said first carriage come into contact with the wheels 53' of the rear axle and this occurs again by known means, such as by checking the current absorption of the carriage propelling motor or alternatively by pressure sensors, limit elements or load cells placed on the arms themselves.

Only when the carriages 100 are positioned at the first and second axles of the vehicle, the pantograph is operated in order to align the longitudinal axis of the vehicle with the longitudinal axis X.

The advantages of the carriage object of the present invention are evident in the light of the description disclosed herein. The rotating clamp elements are still in a simple form and by simple axial-rotation actuation, and are not installed on complex mechanisms that allow them to perform complex movements.

The pantograph used for the longitudinal alignment of the vehicle according to the present invention, in turn has a simple and light operating mechanism, which is therefore inexpensive too and allows adaptation also to gauges of different lengths, and therefore flexible adaptation to the centering of a large number of different vehicles.

In particular the applicant found that, for transverse alignment, relatively small forces are required, although depending on the type of ground. Preferably, although not exclusively, the stop of the controlling motor 201 takes place by reading an increase in the absorbed current, which has a surge when both end portions of the pantograph come into contact with both the wheels of the axle 54. In a technically equivalent and alternative solution, the stop of the controlling motor 201 can be managed by means of limit elements or pressure sensors.

Advantageously, by handling the two independent carriages according to the previously described method it is possible to avoid that at least one of the two carriages, while taking a proper position under an axle, has to be actively operated so that to travel along a direction opposite to the coming direction. More precisely, whether the pair of carriages move from the front direction or the pair of carriages move from the rear direction, the carriages never carry out a centering movement along the opposite direction with respect to the coming one, and this facilitates and speeds up the control of the carriages themselves. It has been found that this provides both time and energy savings. Regarding the time, the saving is given by the elimination of the time required to stop-restart-stop the driving motor to drive the carriage in the opposite direction with respect to the coming direction of the carriage itself. As regards the energy, the saving is given by the fact that by such stopping-restarting and stopping of the driving motor to drive the carriage along said opposite direction with respect to the coming direction of the carriage itself, a considerable absorption of electric current is originated.

By decoupling the driving motors of the arms, the transverse pushers and the carriage driving motors to drive the carriage itself, a completely symmetrical functioning of the two carriages of the parking system is possible, wherein each carriage —even individually considered—can be equivalently enabled to function either by accessing the vehicle from the rear direction and by accessing to it from the front direction.

Lastly, it is evident that additions, modifications or variations, obvious for a person skilled of the art, can be applied to the carriage object of the present invention without thereby departing from the protection scope provided by the enclosed claims.

The invention claimed is:

1. A carriage for handling a vehicle in an automatic parking system, said carriage comprising:

a frame axially movable along a longitudinal axis (X), rotating clamp elements (3, 4, 6, 7) wherein each of said rotating clamp elements (3, 4, 6, 7) comprises, per each side of the carriage, a pair of counter-rotating arms which rotate with respect to a vertical axis (Z) orthogonal to both said longitudinal axis (X) and a transverse axis (Y), transverse-centering means which comprise a pair of transverse pushers (205, 206), which are transversely extensible and move along an axis parallel to or coincident with said transverse axis (Y) and are independent with respect to said rotating clamp elements, said transverse-centering means comprising a first retracted position in which said transverse pushers (205, 206) do not interact with the wheels (53) of said vehicle and a second extended position in which said transverse pushers (205, 206) come into contact with at least one vehicle wheel;

wherein said transverse pushers (205, 206) are arranged on the left side and on the right side of said carriage, and simultaneously move in a symmetrical extension, wherein said transverse pushers (205, 206) are operated by a respective motor (201) positioned laterally with respect to the longitudinal axis (X) of said carriage, and wherein said transverse pushers (205, 206) comprise a pantograph for longitudinally aligning said vehicle (400) along said longitudinal axis (X), and operation of said pair of transverse pushers (205, 206) comprises their symmetrical operation with respect to said longitudinal axis (X), and comprises a movement along said axis parallel to or coincident with said transverse axis (Y), from the first retracted position in which said transverse pushers (205, 206) do not interact with the wheels of said vehicle to the second extended position, in which said transverse pushers (205, 206) interact with at least one wheel (53) of said vehicle, and wherein said carriage comprises an actuating belt or chain guided by rotating sprocket wheels which are engaged thereon, and gears that are engaged with said actuating belt or chain, said gears being configured to transversally extend said transverse pushers (205, 206) and further comprising a worm screw configured for guiding the extension of said pantograph (205).

2. The carriage according to claim 1, wherein said respective motor (201) is installed on said carriage so that a rotation axis of a respective shaft is oriented substantially parallel to the longitudinal axis of the carriage itself, and wherein said respective motor (201) is positioned in substantial proximity to a side crosspiece of the carriage itself.

3. An automated parking system comprising a pair of carriages (100) for handling vehicles according to claim 2, wherein:

said pair of carriages (100) is designed to approach a vehicle (400) along a direction substantially corresponding to a longitudinal movement axis (X), thus identifying in said pair of carriages (100) a first carriage (100) nearer to said vehicle (400) and a second carriage (100) farther from said vehicle (400);

there is a first arrangement in which said second carriage (100) is completely outside the contour of said vehicle (400) and opens the arms (7, 6) which are longitudinally farther with respect to a destination point of said second carriage (100) and positioned on the opposite sides thereof while said first carriage (100) moves forward at least partially under said vehicle (400) thus reaching the latter with the arms (3, 4, 6, 7) substantially aligned with said longitudinal axis (X);

there is a second arrangement in which said second carriage (100) having said arms (3, 4, 6, 7) open comes into contact with the tires (53; 53') of said vehicle (400) while said first carriage (100) is at an intermediate position between two axles of said vehicle (400) and opens said its own arms (6, 7, 3, 4) longitudinally farther with respect to a destination point of said carriage;

and wherein said first and said second carriages (100) are independent of one another.

4. The carriage according to claim 1, wherein said rotating clamp elements (3,4,6,7) cause the position of the transverse axis (Y) of the carriage to be aligned with the axis of the wheels (53).

5. The carriage according to claim 4, wherein said alignment is carried out by rotating said rotating clamp elements engaging the wheels (53) and simultaneously releasing the brake of the driving motor to drive the carriage in the longitudinal direction.

6. An automated parking system comprising a pair of carriages (100) for handling vehicles according to claim 5, wherein:

said pair of carriages (100) is designed to approach a vehicle (400) along a direction substantially corresponding to a longitudinal movement axis (X), thus identifying in said pair of carriages (100) a first carriage (100) nearer to said vehicle (400) and a second carriage (100) farther from said vehicle (400);

there is a first arrangement in which said second carriage (100) is completely outside the contour of said vehicle (400) and opens the arms (7, 6) which are longitudinally farther with respect to a destination point of said second carriage (100) and positioned on the opposite sides thereof while said first carriage (100) moves forward at least partially under said vehicle (400) thus reaching the latter with the arms (3, 4, 6, 7) substantially aligned with said longitudinal axis (X);

there is a second arrangement in which said second carriage (100) having said arms (3, 4, 6, 7) open comes into contact with the tires (53; 53') of said vehicle (400) while said first carriage (100) is at an intermediate position between two axles of said vehicle (400) and opens said its own arms (6, 7, 3, 4) longitudinally farther with respect to a destination point of said carriage;

and wherein said first and said second carriages (100) are independent of one another.

7. An automated parking system comprising a pair of carriages (100) for handling vehicles according to claim 4, wherein:

said pair of carriages (100) is designed to approach a vehicle (400) along a direction substantially corresponding to a longitudinal movement axis (X), thus identifying in said pair of carriages (100) a first carriage (100) nearer to said vehicle (400) and a second carriage (100) farther from said vehicle (400);

there is a first arrangement in which said second carriage (100) is completely outside the contour of said vehicle (400) and opens the arms (7, 6) which are longitudinally farther with respect to a destination point of said second carriage (100) and positioned on the opposite sides thereof while said first carriage (100) moves forward at least partially under said vehicle (400) thus reaching the latter with the arms (3, 4, 6, 7) substantially aligned with said longitudinal axis (X);

there is a second arrangement in which said second carriage (100) having said arms (3, 4, 6, 7) open comes into contact with the tires (53; 53') of said vehicle (400) while said first carriage (100) is at an intermediate position between two axles of said vehicle (400) and opens said its own arms (6, 7, 3, 4) longitudinally farther with respect to a destination point of said carriage;

and wherein said first and said second carriages (100) are independent of one another.

8. An automated parking system comprising a pair of carriages (100) for handling vehicles according to claim 1, wherein:

said pair of carriages (100) is designed to approach a vehicle (400) along a direction substantially corresponding to a longitudinal movement axis (X), thus identifying in said pair of carriages (100) a first carriage (100) nearer to said vehicle (400) and a second carriage (100) farther from said vehicle (400);

there is a first arrangement in which said second carriage (100) is completely outside the contour of said vehicle (400) and opens the arms (7, 6) which are longitudinally farther with respect to a destination point of said second carriage (100) and positioned on the opposite sides thereof while said first carriage (100) moves forward at least partially under said vehicle (400) thus reaching the latter with the arms (3, 4, 6, 7) substantially aligned with said longitudinal axis (X);

there is a second arrangement in which said second carriage (100) having said arms (3, 4, 6, 7) open comes into contact with the tires (53; 53') of said vehicle (400) while said first carriage (100) is at an intermediate position between two axles of said vehicle (400) and opens said its own arms (6, 7, 3, 4) longitudinally farther with respect to a destination point of said carriage;

and wherein said first and said second carriages (100) are independent of one another.

9. The automated parking system according to claim 8, further comprising an initial arrangement in which said first and second carriages (100) are both outside the contour of said vehicle (400) and have arms (6, 7, 3, 4) substantially aligned with said longitudinal axis (X), and wherein the distance between said first and said second carriages (100) changes between said initial arrangement and said first or second arrangement.

10. The automated parking system according to claim 9, wherein said transverse pushers (205, 206) are activated after the moment in which said arms (3, 4, 6, 7), which are longitudinally farther from a destination point of said carriage (100), are in contact with said wheel.

11. The automated parking system according to claim 10, comprising adjusting means to adjust the linear translation speed of said first and/or second carriages (100) along said longitudinal axis (X).

12. A method of actuating a pair of carriages for handling a vehicle in an automated parking system in which said pair of carriages are adapted to insert themselves at least partially under said vehicle (400) and in which each carriage (100) of said pair comprises rotating clamp elements (3, 4, 6, 7) which in turn comprise a pair of counter-rotating arms on a pair of sides of said carriage (100), the pair of counter-rotating arms being rotatable with respect to a vertical axis (Z) orthogonal to both a longitudinal axis (X) and a transverse axis (Y), said method comprising:

an approaching step wherein said vehicle (400) is approached by a pair of vehicle-handling carriages (100) along a direction substantially coincident with the longitudinal axis (X) of the vehicle (400) itself, wherein, in said approach, a first carriage (100) closer to said vehicle and a second carriage (100) farther from said vehicle and independent of said first carriage (100) are identified;

an actuating step to actuate said rotating clamp elements (3, 4, 6, 7) of said second carriage, and wherein said actuating step comprises opening the arms (7, 6) longitudinally farther from a destination point of said second carriage (100); a stopping step to stop said second carriage (100)

when said arms longitudinally farther with respect to said destination point of said second carriage (100) come into contact with the wheels (53, 53') of an axle of the vehicle (400) which is closer to said second carriage;

a pursuing step to pursue the travel of said first carriage (100) under said vehicle (400), the step comprising opening said pair of arms longitudinally farther with respect to the destination point of said first carriage (100) when the latter is at an intermediate position between the first and the second axles of the vehicle (400); and an operating step to operate a pair of transverse pushers (205, 206) which are transversely extensible and move along an axis parallel to or coincident with said transverse axis (Y) and are independent with respect to said rotating clamp elements;

wherein in a first retracted position the transverse pushers (205, 206) do not interact with the wheels (53) of said vehicle and a second extended position in which said transverse pushers (205, 206) come into contact with at least one vehicle wheel, wherein said transverse pushers (205, 206) are arranged on the left side and on the right side of said carriage and simultaneously move in a symmetrical extension, wherein said transverse pushers (205, 206) comprise a pantograph for longitudinally aligning said vehicle (400) along said longitudinal axis (X), and wherein operation of said transverse pushers (205, 206) comprises their symmetrical operation with respect to said longitudinal axis (X), and comprises a movement along said axis parallel to or coincident with said transverse axis (Y), from the first retracted position in which said transverse pushers (205,206) do not interact with the wheels of said vehicle to the second extended position, in which said transverse pushers (205,206) interact with at least one wheel (53) of said vehicle, and wherein said activating step to activate said transverse pushers (205, 206) comprises a guiding step to guide an actuating belt or chain by rotating sprocket wheels which are engaged thereon, wherein said actuating belt or chain engages gears that transversally extend said transverse pushers (205, 206) and wherein said actuating step to actuate said transverse pushers comprises the actuation of a worm screw guiding the extension of said pantograph (205).

13. The method according to claim 12, wherein the said actuation of said pair of transverse pushers (205, 206) comprises causing an outer end portion of at least one of said transverse pushers (205, 206) to carry out a movement, said movement causing them to come into contact with a transversely misaligned wheel (53) of said vehicle, during the extension towards said second position.

14. The method according to claim 13, further comprising a step of further extending towards at least one second extending position in which at least one of said transverse pushers (205, 206), during the interaction, transversely pushes said wheel up to a position which forces at least one axle (54) of said vehicle to be transversely centered with respect to said longitudinal axis of said carriage.

15. The method according to claim 13, wherein said activating step to activate said transverse pushers (205, 206) takes place concurrently or slightly before an actuating step to actuate said rotating clamp elements (3, 4, 6, 7).

16. The method according to claim 12, further comprising a step of further extending towards at least one second extending position in which at least one of said transverse pushers (205, 206), during the interaction, transversely pushes said wheel up to a position which forces at least one axle (54) of said vehicle to be transversely centered with respect to said longitudinal axis of said carriage.

17. The method according to claim 12, wherein said activating step to activate said transverse pushers (205, 206) takes place concurrently or slightly before an actuating step to actuate said rotating clamp elements (3, 4, 6, 7).

18. The method according to claim 12, wherein said activating step to activate said transverse pushers (205, 206) takes place after the activation of said rotating clamp elements (3, 4, 6, 7).

19. A method of actuating a pair of carriages for handling a vehicle in an automated parking system in which said pair of carriages are adapted to insert themselves at least partially under said vehicle (400) and in which each carriage (100) of said pair comprises rotating clamp elements (3, 4, 6, 7) which in turn comprise a pair of counter-rotating arms on a pair of sides of said carriage (100), said method comprising:

an approaching step wherein said vehicle (400) is approached by a pair of vehicle-handling carriages (100) along a direction substantially coincident with a longitudinal axis (X) of the vehicle (400) itself, wherein, in said approach, a first carriage (100) closer to said vehicle and a second carriage (100) farther from said vehicle and independent of said first carriage (100) are identified;

an actuating step to actuate said rotating clamp elements (3, 4, 6, 7) of said second carriage, and wherein said actuating step comprises opening the arms (7, 6) longitudinally farther from a destination point of said second carriage (100); a stopping step to stop said second carriage (100) when said arms longitudinally farther with respect to said destination point of said second carriage (100) come into contact with the wheels (53, 53') of an axle of the vehicle (400) which is closer to said second carriage;

a pursuing step to pursue the travel of said first carriage (100) under said vehicle (400), the step comprising opening said pair of arms longitudinally farther with respect to the destination point of said first carriage (100) when the latter is at an intermediate position between the first and the second axles of the vehicle (400); and an operating step to operate a pair of transverse pushers, independent with respect to said rotating clamp elements and installed on board said first and said second carriages (400), in which step the longitudinal axis of the vehicle (400) is aligned with a movement axis (X) of at least one of said first or second carriage (400), wherein the operation of said pair of transverse pushers (205, 206) comprises their symmetrical operation with respect to said movement axis (X), and comprises a movement along an axis parallel to or coincident with said transverse axis (Y), from a first retracted position in which said transverse pushers (205, 206) do not interact with the wheels of said vehicle to a second extended position, in which said transverse pushers (205, 206) interact with at least one wheel (53) of said vehicle, and wherein said activating step to activate said transverse pushers (205, 206) comprises a guiding step to guide an actuating belt or chain by rotating sprocket wheels which are engaged thereon, wherein said actuating belt or chain engages gears that transversally extend said transverse pushers (205, 206) and wherein said actuating step to actuate said transverse pushers comprises the actuation of a worm screw guiding the extension of said pantograph (205).

* * * * *